US008935817B2

(12) United States Patent
Suh

(10) Patent No.: US 8,935,817 B2
(45) Date of Patent: Jan. 20, 2015

(54) MOTORIZED FOLDABLE BED FRAME ASSEMBLY

(71) Applicant: Bernard Suh, Ambler, PA (US)

(72) Inventor: Bernard Suh, Ambler, PA (US)

(73) Assignee: Pragma Corporation, Colmar, PA (US)

( * ) Notice: Subject to any disclaimer, the term of this patent is extended or adjusted under 35 U.S.C. 154(b) by 0 days.

(21) Appl. No.: 13/919,423

(22) Filed: Jun. 17, 2013

(65) Prior Publication Data

US 2014/0366267 A1 Dec. 18, 2014

(51) Int. Cl.
*A47C 19/12* (2006.01)

(52) U.S. Cl.
CPC ..... *A47C 19/12* (2013.01)
USPC ..... 5/174; 5/613; 5/616

(58) Field of Classification Search
CPC ..... A61G 7/015; A61G 7/018; A61G 13/08; A61G 2203/12; A61G 7/005; A61G 5/006; A47C 20/041; A47C 20/08; A47C 31/008; A47C 19/021
USPC ..... 5/174, 613, 616, 617, 618, 620, 149
See application file for complete search history.

(56) References Cited

U.S. PATENT DOCUMENTS

| | | | | |
|---|---|---|---|---|
| 2,147,538 | A * | 2/1939 | Maguire et al. | 5/411 |
| 4,670,922 | A | 6/1987 | Mis | |
| 4,970,737 | A | 11/1990 | Sagel | |
| 5,109,556 | A * | 5/1992 | Cook | 5/110 |
| 5,216,769 | A | 6/1993 | Eakin | |
| 5,245,718 | A | 9/1993 | Krauska | |
| 5,438,723 | A | 8/1995 | Carroll | |
| 6,009,575 | A | 1/2000 | Hsieh | |
| 6,035,467 | A | 3/2000 | Lee | |
| 6,076,210 | A * | 6/2000 | Wu | 5/618 |
| 6,101,649 | A * | 8/2000 | Wu | 5/618 |
| 6,151,730 | A | 11/2000 | Weston | |
| 6,209,157 | B1 | 4/2001 | Hensley | |
| 6,253,396 | B1 | 7/2001 | Weston | |
| 6,735,797 | B1 | 5/2004 | Long et al. | |
| 6,826,793 | B2 | 12/2004 | Tekulve | |
| 6,907,631 | B2 | 6/2005 | Heaton | |
| 6,990,698 | B2 | 1/2006 | Wall, Sr. | |
| 7,093,312 | B2 | 8/2006 | Mossbeck | |

(Continued)

FOREIGN PATENT DOCUMENTS

| | | | |
|---|---|---|---|
| CN | 202496798 | U | 10/2012 |
| JP | 2000152852 | A | 6/2000 |

OTHER PUBLICATIONS

PCT International Searching Authority/KR, International Search Report mailed Jan. 21, 2013, International Application No. PCT/US2012/054012.

(Continued)

*Primary Examiner* — Robert G Santos
*Assistant Examiner* — Richard G Davis
(74) *Attorney, Agent, or Firm* — John H. Choi

(57) ABSTRACT

A motorized foldable bed frame assembly configured to fold from an open co-planar assembly to a closed parallel assembly. An embodiment of the present disclosure is a dual-actuating adjustable bed frame that is collapsible and foldable for ease of shipping, and may be configured for use by extending pivoting frame sections and engaging collapsible support legs. A motorized foldable bed frame assembly may include a head adjustable frame, or a head and foot adjustable frame.

13 Claims, 10 Drawing Sheets

(56) References Cited

U.S. PATENT DOCUMENTS

| | | | | |
|---|---|---|---|---|
| 7,493,667 | B2 | 2/2009 | Ferko, III | |
| 7,861,338 | B2 | 1/2011 | Lee | |
| 7,900,302 | B2 | 3/2011 | Long | |
| 7,930,780 | B2 * | 4/2011 | Clenet | 5/618 |
| 8,056,159 | B2 | 11/2011 | Lee et al. | |
| 2002/0016992 | A1 * | 2/2002 | Weston | 5/110 |
| 2002/0144350 | A1 | 10/2002 | Shih | |
| 2007/0277317 | A1 * | 12/2007 | Ferko | 5/620 |
| 2008/0276373 | A1 | 11/2008 | Clenet | |
| 2011/0099712 | A1 * | 5/2011 | Jin | 5/174 |
| 2012/0198623 | A1 * | 8/2012 | Clenet et al. | 5/600 |
| 2013/0312185 | A1 | 11/2013 | Suh | |

OTHER PUBLICATIONS http://sell.bizrice.com/selling-leads/798304/Electric-adjustable-bed-HY-D008.html "Electric adjustable bed HY-D008".

http://www.adjustablemedicalbeds.com/china-electric__homecare__adjustable__invacare__hospital__bed__with__heavy__duty__frame__hand__pendant-389111.html "Electric homecare adjustable Invacare hospital bed with heavy duty frame / hand pendant".

http://sell.bizrice.com/selling-leads/132775/electric-steel-bed-frame-on-promotion.html "electric steel bed frame-on promotion".

* cited by examiner

MOTORIZED FOLDABLE BED FRAME ASSEMBLY

FIELD

The present disclosure relates to the field of bed frames, in particular, a motorized foldable bed frame assembly configured to fold from an open co-planar assembly to a closed or folded parallel assembly.

SUMMARY

Numerous solutions for motorized bed frames exist in the prior art. However, no solutions exist for a motorized bed frame assembly that can be folded directly in half such that opposing frame portions do not interfere with each other; can be easily extended by a user without the use of tools; and can be packaged and shipped according to major shipping service providers (e.g., United Parcel Service, Federal Express, and United States Postal Service) size and weight regulations. For example, according to June 2013 guidelines, United Parcel Service restricts packages to 150 lbs (70 kg); up to 165 inches (419 cm) in length and girth combined; and, up to 108 inches (270 cm) in length. Embodiments of the present disclosure provide for a light-weight (under 150 lbs) motorized bed frame assembly that is easily configured by the user (e.g., extendable and collapsible without the use of tools), and can be folded directly in half to ensure compliance and reduced cost with major shipping service providers and reduces storage volume requirements as compared to other prior art solutions.

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present invention is to provide a bed frame comprising: an outer assembly comprising: an outer torso section and an outer leg section, said outer torso and outer leg sections each having a frame defining an outer perimeter; at least one structural support bar coupled to each of said outer torso and outer leg sections and positioned within the outer perimeter; and at least one support leg pivotally coupled to each of said outer torso and outer leg sections; a central leg assembly having at least one support leg, the outer torso and outer leg sections pivotally coupled together by the central leg assembly; an inner assembly comprising: an inner torso section, the inner torso section having a frame defining an inner perimeter; and at least one structural support bar coupled to said inner torso section and positioned within the inner perimeter; wherein the inner torso section is positioned within the outer perimeter of the outer torso section and pivotally coupled thereto; and a first actuating assembly comprising: a first actuator coupled to a first movable jack extending therefrom, the first actuator pivotally coupled to the at least one structural support bar of the outer torso section; and a first bracket comprising a first end and a second end, said first end pivotally coupled to the at least one structural support bar of the inner torso section and said second end pivotally coupled to a distal end of the first movable jack; wherein the first movable jack is fully extended when the inner torso section and the outer torso section are substantially co-planar and the first movable jack is less than fully extended when the inner torso section is raised from the outer torso section.

Another object of the present invention is to provide a bed frame comprising: an outer assembly comprising: an outer torso section and an outer leg section, said outer torso and outer leg sections each having a frame defining an outer perimeter; at least one structural support bar coupled to each of said outer torso and outer leg sections and positioned within the outer perimeter; and at least one support leg pivotally coupled to each of said outer torso and outer leg sections; a central leg assembly having at least one support leg, the outer torso and outer leg sections pivotally coupled together by the central leg assembly; an inner assembly comprising: an inner torso section, the inner torso section having a frame defining an inner perimeter; and at least one structural support bar coupled to said inner torso section and positioned within the inner perimeter; wherein the inner torso section is positioned within the outer perimeter of the outer torso section and pivotally coupled thereto; and a first actuating assembly comprising: a first actuator coupled to a first movable jack extending therefrom; and a first bracket comprising a first end and a second end; wherein one of the first actuator and first movable jack is pivotally coupled to the at least one structural support bar of the outer torso section, the other one of the first actuator and first movable jack is pivotally coupled to the first bracket first end, and the first bracket second end is pivotally coupled to the at least one structural support bar of the inner torso section.

Yet another object of the present invention is to provide a bed frame comprising: a support assembly comprising: a torso section and a leg section; at least one structural support bar coupled to each of said torso and leg sections; and at least one support leg coupled to each of said torso and leg sections; at least one adjustable assembly comprising: a frame, the frame having at least one structural support bar coupled thereto; wherein the at least one adjustable assembly is positioned on the support assembly and pivotally coupled thereto; and at least one actuating assembly comprising a first end and a second end; and at least one bracket comprising a first end and a second end, the at least one bracket first end pivotally coupled to the at least one actuating assembly second end; wherein one of the at least one actuating assembly first end and the at least one bracket second end is pivotally coupled to the support assembly, and the other one of the at least one actuating assembly first end and the at least one bracket second end is pivotally coupled to the at least one adjustable assembly.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

Figure 1:
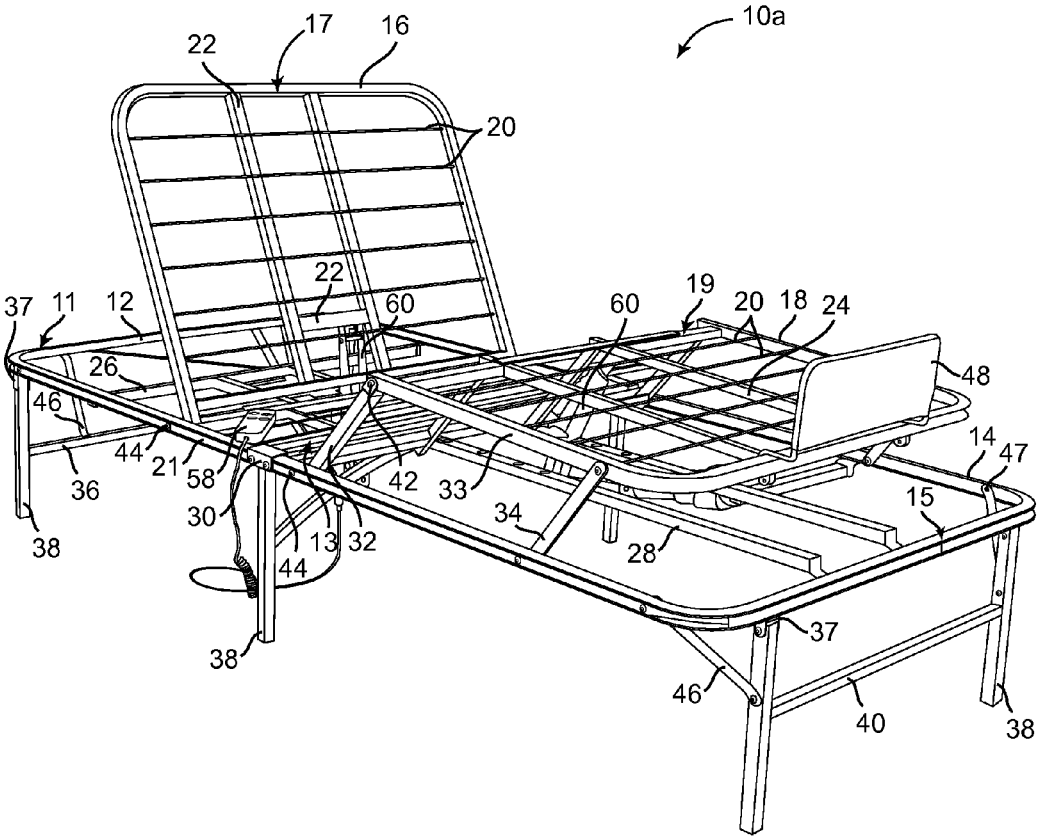
FIG. 1 is a perspective view of a first embodiment of a bed frame of the present invention in an open and elevated or raised configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

FIG. 1 is a perspective view of an embodiment of a motorized foldable bed frame assembly 10*a* of the present invention in an open and elevated configuration. The foldable bed frame 10*a* is comprised generally of an outer torso assembly 11, an outer leg assembly 15, and a central leg assembly 13. In exemplary embodiments, the bed frame 10*a* in the open configuration may have overall dimensions of 75"×39" (Twin); 80"×38" (Twin XL); or 80"×30". Other sizes are anticipated, such as an 80"×60" (Queen) bed frame, and an 80"×76" (King) bed frame. It is anticipated that the preferred embodiment has 14" of clearance between the floor and outer assemblies 11 and 15. In an exemplary embodiment, the bed frame 10*a* is constructed from powder-coated steel, although numerous alternative construction materials are anticipated.

Referring again to FIG. 1, the outer torso assembly 11 includes an outer torso section 12 and the outer leg assembly 15 includes an outer leg section 14, each defining a substantially rectangular outer perimeter. The outer torso section 12 may be supported by structural support bars 26, which may be fixed to the outer torso section 12 within the outer perimeter. In this embodiment, the outer torso section 12 includes a seat portion 21 formed by structural support bars 26. One or more support legs 38 may be pivotally coupled to distal ends of the outer torso section 12 by frame leg coupling members 37. The frame leg coupling members 37 may be any hinge or pin configured to enable the support legs 38 to pivot in a substantially 90 degree path in relation to the outer torso section 12 between an engaged position and a folded position. A leg support bar 36 may be fixedly coupled between opposing support legs 38 to provide structural stability to the support legs 38 and the outer torso section 12. A support arm 46 may be coupled to the outer torso section 12 to maintain the support legs 38 in the engaged position as shown in FIG. 1.

Still referring to FIG. 1, the outer leg section 14 may be supported by structural support bars 28, which may be fixed to the outer leg section 14 within the outer perimeter. Support legs 38 may be pivotally coupled to distal ends of the outer leg section 14 by frame leg coupling members 37. The frame leg coupling members 37 may be any hinge, pin, bolt, or the like, configured to enable the support legs 38 to pivot in a substantially 90 degree path in relation to outer leg section 14 between an engaged position and a folded position. A leg support bar 40 may be fixedly coupled between opposing support legs 38 to provide structural stability to the support legs 38 and outer leg section 14. The support legs 38 may be selectively fixed in an extended position by one or more coupling support arms 46 to the outer leg frame 14 to maintain the support legs 38 in the engaged position as shown in FIG. 1. In this embodiment, the support arm 46 is coupled to the outer leg section 14 by engaging a support bolt 47 with an aperture positioned on the outer leg section 14. The support bolt 47 is secured by a wing nut to enable mechanical torque by manual manipulation without the use of a tool, such as a screw driver or hex key.

Figure 2:
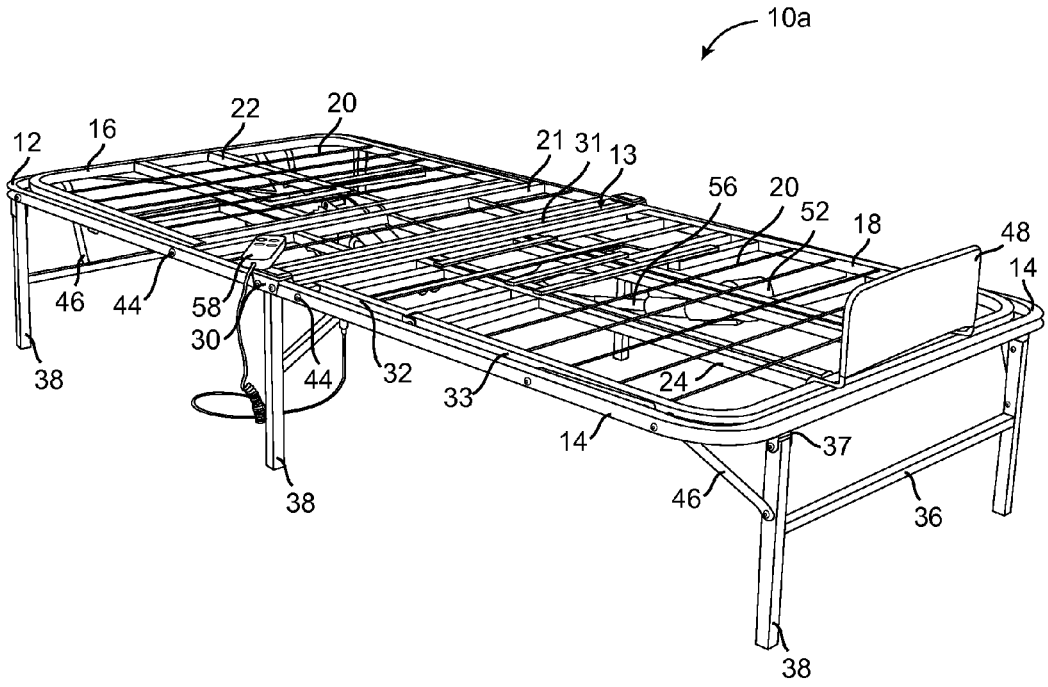
FIG. 2 is a perspective view of the bed frame of FIG. 1 in an open and flat configuration.

Referring to FIGS. 1 and 2, the bed frame 10*a* may further comprise an inner torso assembly 17 and an inner leg assembly 19. When in use, a mattress may be removably coupled to the inner torso assembly 17 and the inner leg assembly 19. The inner torso assembly 17 and the inner leg assembly 19 may be comprised generally of an inner torso section 16 and an inner leg section 18, respectively, each defining a substantially rectangular inner perimeter. Structural support bars 22, 24 may be fixedly coupled to the inner torso and leg sections 16, 18 to increase structural integrity and load tolerance. Mattress support bars 20 may be coupled to the inner torso section 16 and inner leg section 18 to provide support points for a mattress.

Referring again to FIGS. 1 and 2, the inner leg section 18 includes a thigh portion 32 and a calf portion 33. Support bars 24 may be fixedly coupled to each of the thigh and calf portions 32, 33 to increase structural integrity and load tolerance. A mattress retainer 48 may be rotatably coupled to a distal end of the inner leg section 18 such that it may be folded flat in a closed position (FIG. 3) or engaged to retain a mattress in an extended position (FIGS. 1 and 2). The calf portion 33 may be pivotally coupled to the thigh portion 32 by an inner leg frame coupling member 42. The inner leg frame coupling member 42 should be configured to allow for movement between the thigh and calf portions 32, 33. The inner leg section 18 may be pivotally coupled to the outer leg section 14 by a leg frame arm 34. The leg frame arm 34 may provide stability for the inner leg assembly 19 when moving between an engaged or raised configuration (FIG. 1) and a flat configuration (FIG. 2).

Figure 3:
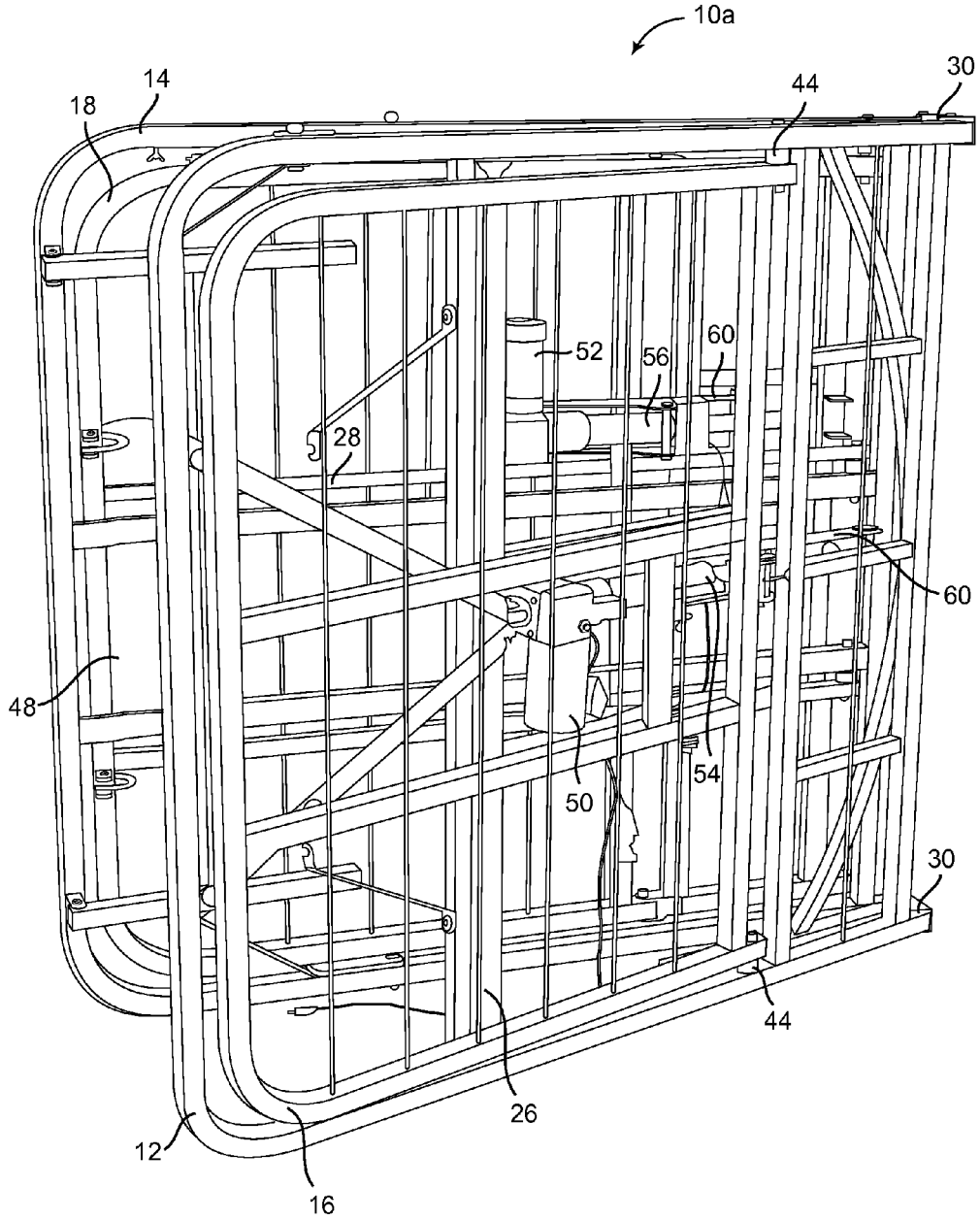
FIG. 3 is a perspective view of the bed frame of FIG. 1 in a partially folded and flat configuration.

Referring to FIGS. 1-3, in an embodiment, the inner torso assembly 17 and the inner leg assembly 19 are pivotally connected to the outer torso assembly 11 and the outer leg assembly 15, respectively, by assembly coupling members 44. Assembly coupling members 44 may be a hinge, bolt, pin, or the like, configured to enable the inner torso assembly 17 and inner leg assembly 19 to pivot in response to engagement with an actuating assembly, which is described in detail below.

Referring again to FIGS. 1-3, in a preferred embodiment, the outer torso assembly 11 and the outer leg assembly 15 are pivotally coupled to the central leg assembly 13 by frame coupling members 30. The central leg assembly 13 may be comprised of support legs 38 and a center frame bar 31. The frame coupling members 30 may be a hinge, bolt, pin, or the like, configured to enable the outer torso assembly 11 and the outer leg assembly 15 to pivot in a substantially 90 degree path in relation to the central leg assembly 13 between the open position (FIGS. 1 and 2) and the folded position (FIG. 3).

FIG. 3 is a perspective view of the motorized foldable bed frame assembly of FIG. 1 in a substantially closed or folded position. In a preferred embodiment, the foldable bed frame 10*a* has a torso actuator 50 and a leg actuator 52. In the preferred embodiment, the torso actuator 50 and leg actuator 52 are 12V electric linear actuating motors, although other commercially equivalent actuating motors are anticipated. The torso actuator 50 may be fixedly coupled to a structural support bar 26 and operably engaged with a jack 54. The jack 54 may be pivotally coupled to the inner torso section 16 such that when the torso actuator 50 is engaged, the jack 54 extends and retracts to elevate or recline the inner torso section 16.

Figure 7:
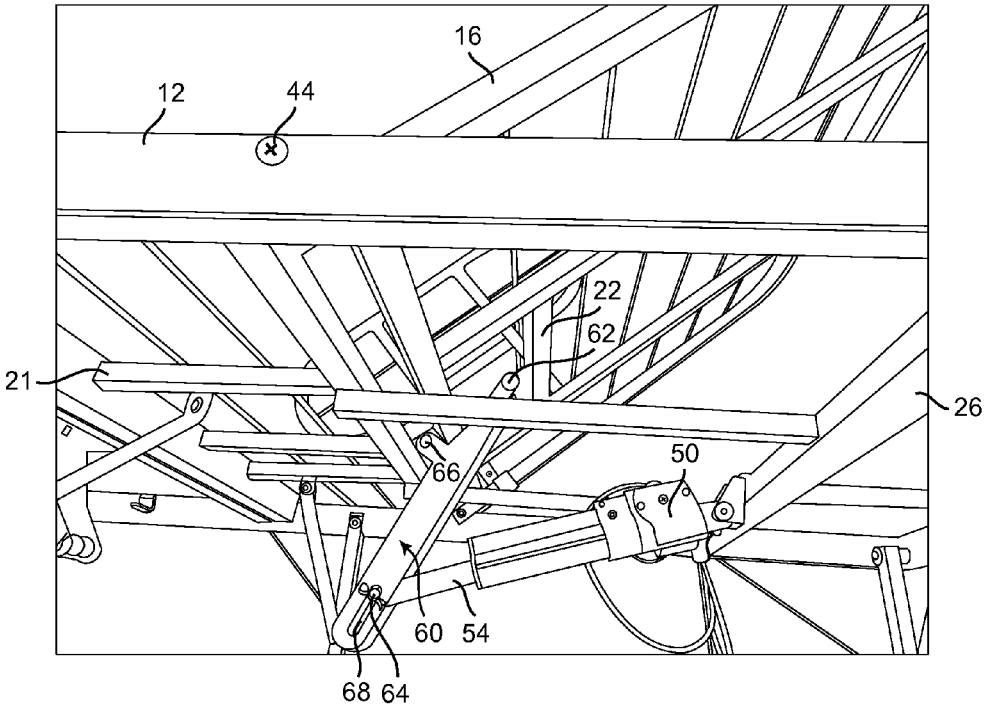
FIG. 7 is a side perspective view of the bed frames of the first and second embodiments (FIGS. 1-6) showing a torso section of the bed frame in an open and raised configuration.
Figure 8:
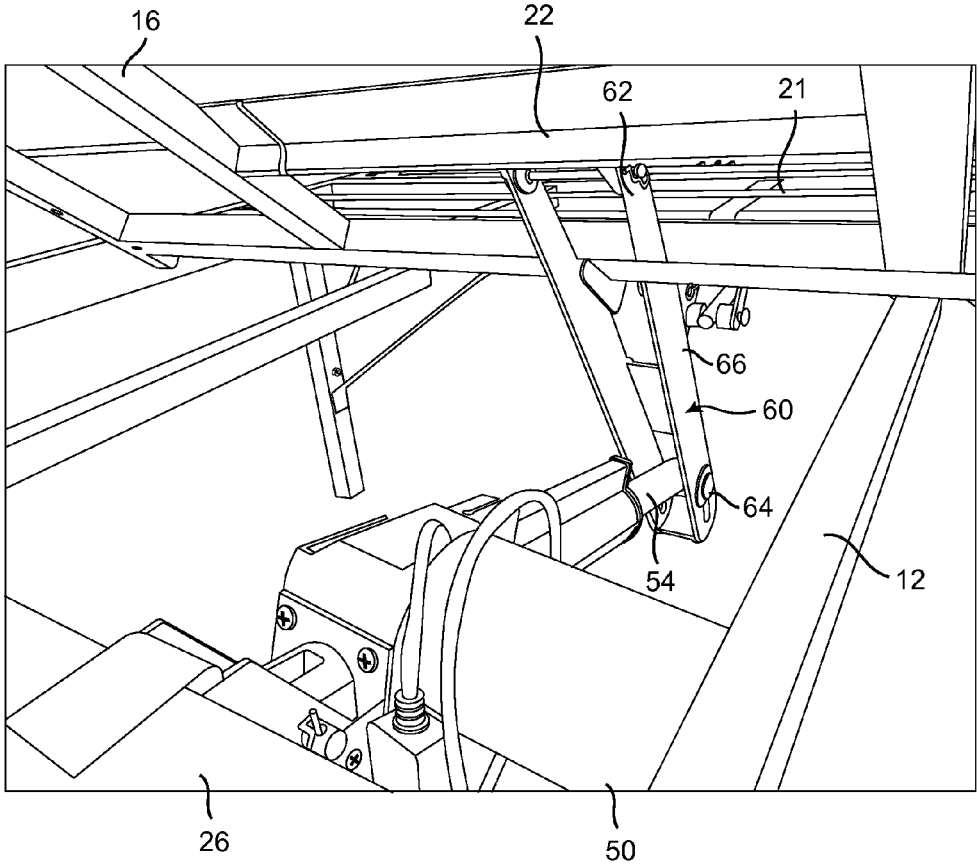
FIG. 8 is an alternate perspective view of the torso section shown in FIG. 7.

Referring to FIGS. 3, 7 and 8, the bed frame 10*a* includes a bracket 60 having a first end 62, a second end 64 and an intermediate portion 66 between the first and second ends 62, 64. The first end 62 is pivotally coupled to a structural support bar 22 of the inner torso section 16. The second end 64 is pivotally coupled to a distal end of the jack 54. The intermediate portion 66 is pivotally coupled to the inner torso section 16 and the seat portion 21 of the outer torso section 12 by one or more extensions extending therefrom. The second end 64 also includes a slot 68 which provides for the jack 54 to slide therein. Thus, the actuator 50, jack 54 and bracket 60 form a first actuating assembly for raising and lowering the inner torso section 16 between a flat configuration (FIG. 1) to a raised configuration (FIG. 2). In the preferred embodiment, the jack 54 is fully extended and overlapped with the bracket 60 when the inner torso section 16 is in a flat configuration (FIGS. 2 and 3), and the jack 54 is retracted and the bracket 60 is positioned at an angle from the outer torso section 12 when the inner torso section 16 is in a raised configuration (FIGS. 1, 7 and 8).

Figure 9:
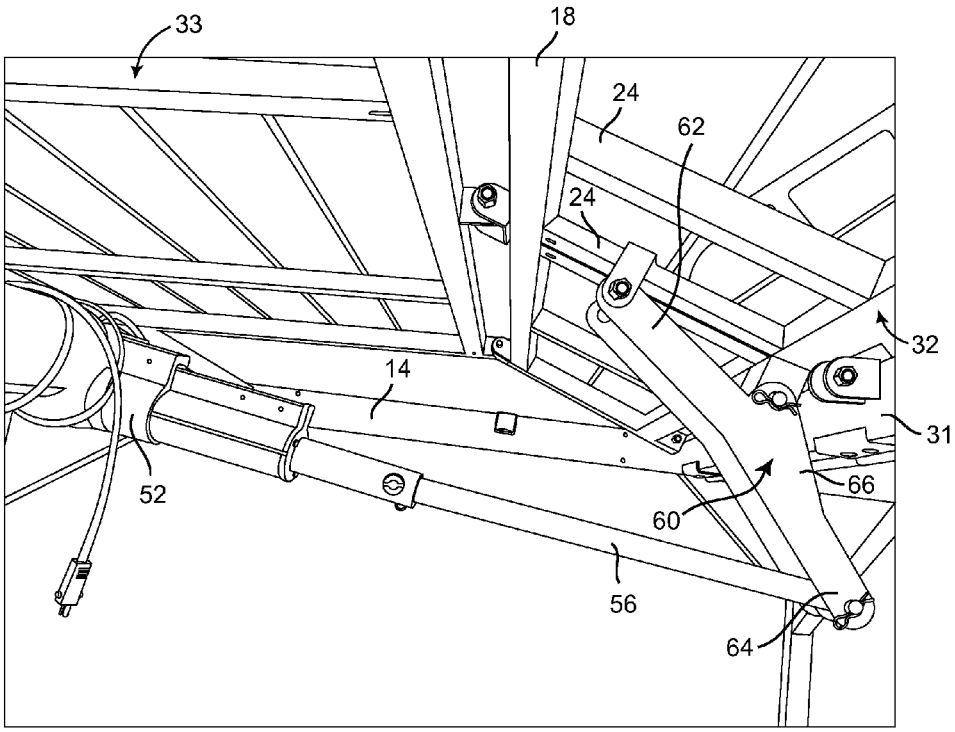
FIG. 9 is a side perspective view of the bed frame of the first embodiment (FIGS. 1-3) showing a leg section of the bed frame in an open and raised configuration.
Figure 10:
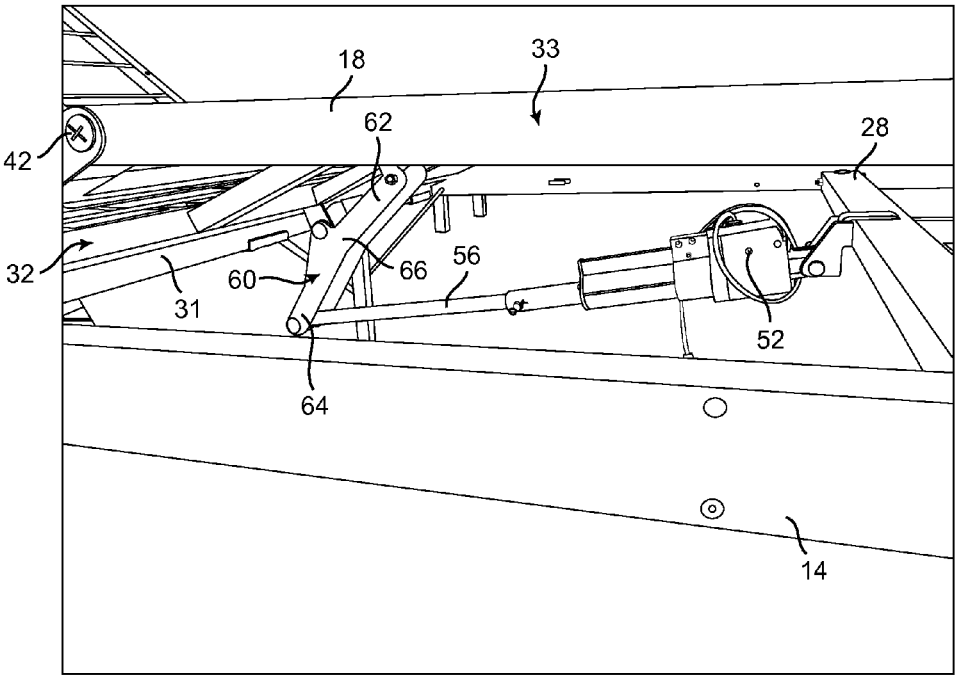
FIG. 10 is an alternate side perspective view of the leg section shown in FIG. 9.

Referring to FIGS. 3, 9 and 10, the leg actuator 52 may be fixedly coupled to a structural support bar 28 of the outer leg section 14 and operably engaged with a jack 56. The jack 56 may be pivotally coupled to the inner leg section 18 such that when the leg actuator 52 is engaged, the jack 56 extends and retracts to elevate or recline the inner leg section 18. More specifically, the bed frame 10*a* includes a bracket 60 having a first end 62, a second end 64 and an intermediate portion 66 between the first and second ends 62, 64. The first end 62 is pivotally coupled to a structural support bar 24 of the inner leg section 18. The second end 64 is pivotally coupled to a distal end of the jack 56. The intermediate portion 66 is pivotally coupled to the inner leg section 18 by one or more extensions extending therefrom. Thus, the actuator 52, jack 56 and bracket 60 form a second actuating assembly for raising and lowering the inner leg section 18 between a flat configuration (FIG. 1) to a raised configuration (FIG. 2). In the preferred embodiment, the jack 56 is fully extended and overlapped with the bracket 60 when the inner leg section 18 is in a flat configuration (FIGS. 2 and 3), and the jack 56 is retracted and the bracket 60 is positioned at an angle from the outer leg section 14 when the inner leg section 18 is in a raised configuration (FIGS. 1, 9 and 10).

Referring to FIGS. 1 and 2, the foldable bed frame 10*a* may have an actuator controller 58 configured to selectively engage the torso actuator 50 and the leg actuator 52 to elevate or recline the inner torso section 16 and the inner leg section 18, respectively. The actuator controller 58 may be any wireline or wireless electronic control module capable of communicating an electronic input to the actuators 50, 52. In an embodiment, the actuator controller 58 contains an adapter configured to control the torso actuator 50 and the leg actuator 52 simultaneously. In a preferred embodiment, the torso actuator 50 and the leg actuator 52 are coupled to structural support bars 22 and 28 of the outer torso and leg sections 12 and 14 in a mirrored configuration relative to each other, such that when the bed frame 10*a* is configured in a folded configuration (see, e.g. FIGS. 3 and 6), the actuators 50 and 52 are free from interference in relation to each other.

Figure 4:
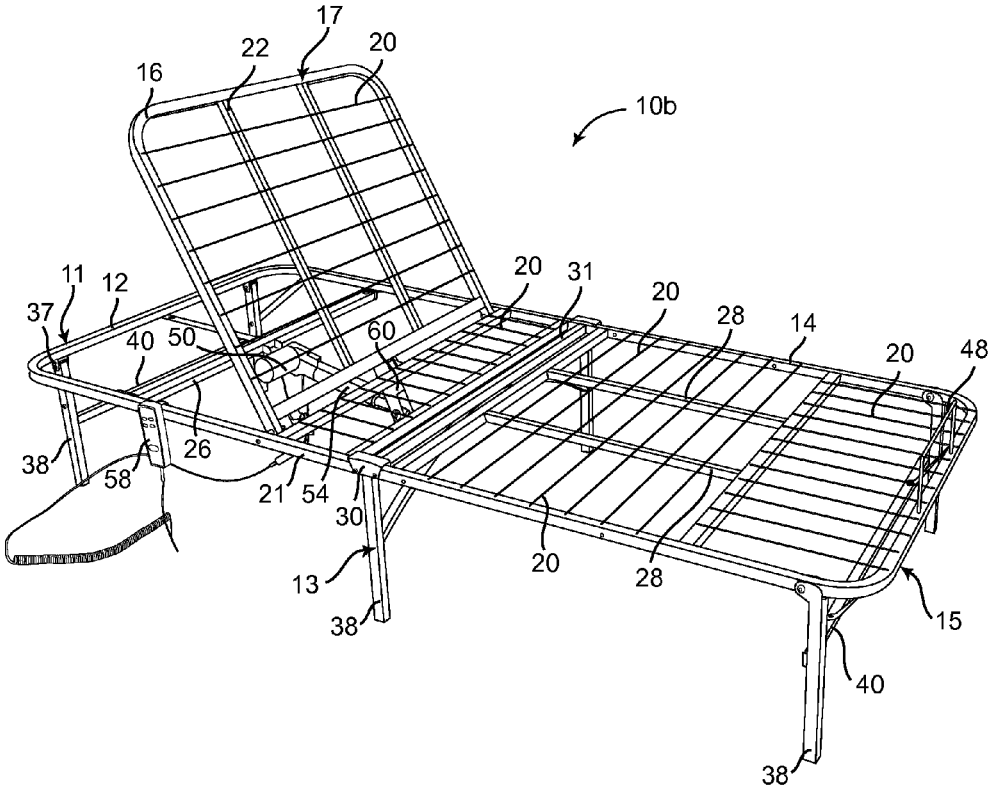
FIG. 4 is a perspective view of a second embodiment of a bed frame of the present invention in an open and elevated or raised configuration.
Figure 5:
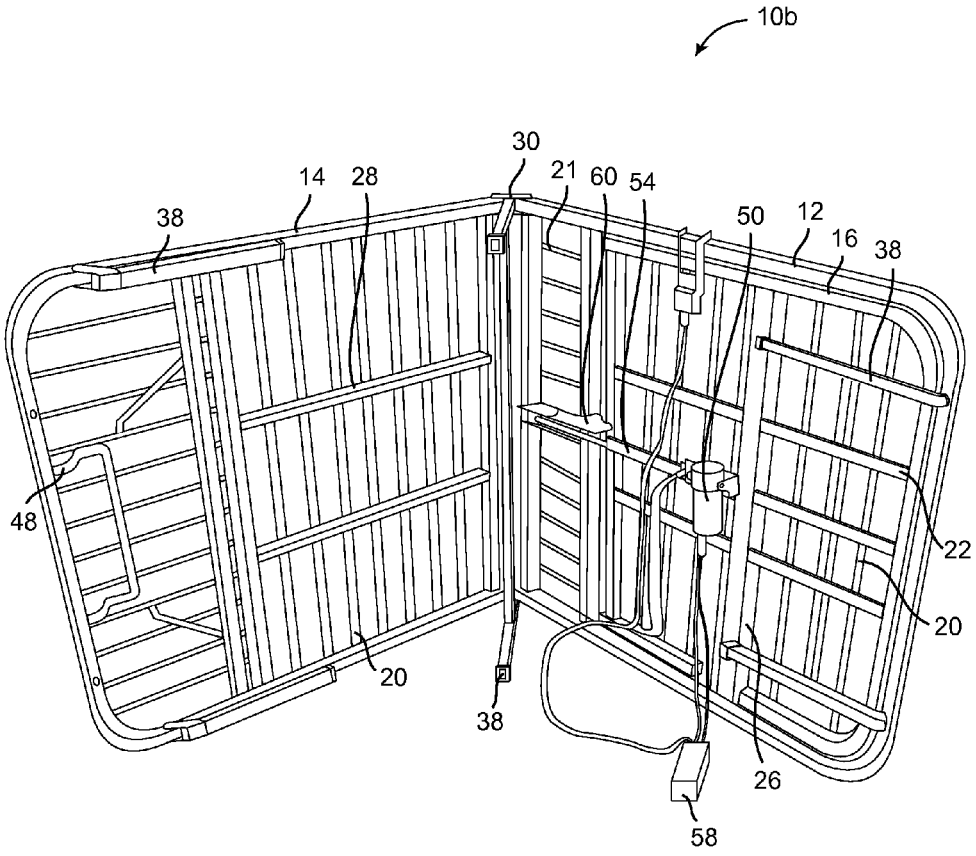
FIG. 5 is a perspective view of the bed frame of FIG. 4 in a partially folded and flat configuration.
Figure 6:
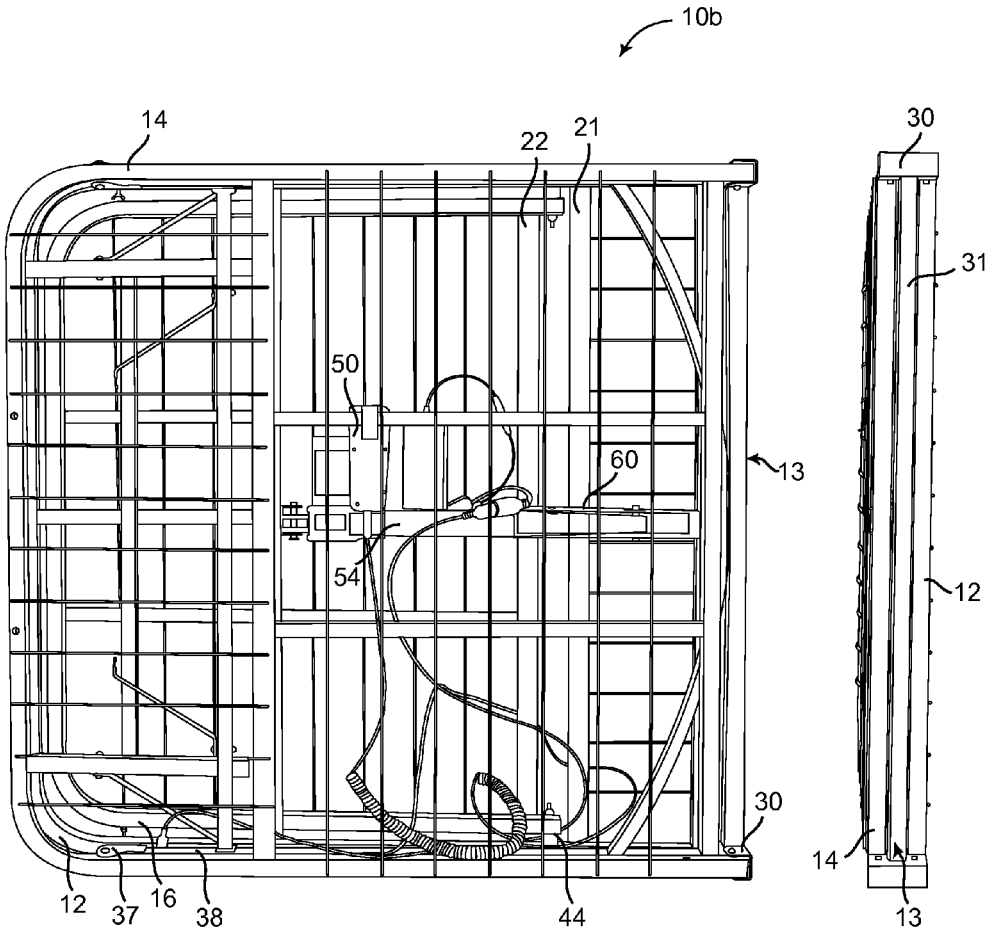
FIG. 6 is a front view and a side view of the bed frame of FIG. 4 in a folded and flat configuration.

Referring to FIGS. 4-6, a second embodiment of the foldable bed frame 10*b* of the present invention is shown. In this embodiment, the bed frame 10*b* is of substantially the same form as that of dual actuating foldable bed frame 10*a* without the inner leg assembly 19 and the second actuating assembly for the inner leg section 18 (i.e., leg actuator 52, jack 56 and corresponding bracket 60). That is, only the user's torso is articulated as described above and the user's legs are statically supported by the outer leg assembly 15 without articulation. Therefore, the description above with respect to the first embodiment 10*a* is incorporated by reference in the description for the second embodiment 10*b* and like elements are shown in the figures.

In the preferred embodiments, the single actuating foldable bed frame 10*b* and dual actuating foldable bed frame 10*a* fold substantially flat in a folded configuration as shown for example in FIG. 6 such that the outer torso section 12 and the outer leg section 14 are parallel in relation to each other. When collapsed in the folded configuration, the single actuating foldable bed frame 10*b* and dual actuating foldable bed frame 10*a* may have an overall height of between about three inches and about eight inches. Configuring the single actuating foldable bed frame 10*b* and the dual actuating foldable bed frame 10*a* in a folded configuration may reduce packaging and shipping costs of the motorized bed frame and may reduce set-up time for a user.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A bed frame comprising:

an outer assembly comprising: an outer torso section and an outer leg section, said outer torso and outer leg sections each having a frame defining an outer perimeter; at least one structural support bar coupled to each of said outer torso and outer leg sections and positioned within the outer perimeter; and at least one support leg pivotally coupled to each of said outer torso and outer leg sections;

a central leg assembly having at least one support leg, the outer torso and outer leg sections pivotally coupled together by the central leg assembly;

an inner assembly comprising: an inner torso section, the inner torso section having a frame defining an inner perimeter; and at least one structural support bar coupled to said inner torso section and positioned within the inner perimeter; wherein the inner torso section is positioned within the outer perimeter of the outer torso section and pivotally coupled thereto; and a first actuating assembly comprising: a first actuator coupled to a first movable jack extending therefrom, the first actuator pivotally coupled to the at least one structural support bar of the outer torso section; and a first bracket comprising a first end and a second end, said first end pivotally coupled to the at least one structural support bar of the inner torso section and said second end pivotally coupled to a distal end of the first movable jack; wherein the first movable jack is fully extended when the inner torso section and the outer torso section are substantially co-planar and the first movable jack is less than fully extended when the inner torso section is raised from the outer torso section.

2. The bed frame of claim 1, wherein the inner assembly further comprises an inner leg section, the inner leg section having a frame defining an inner perimeter; and at least one structural support bar coupled to said inner leg section and positioned within the inner perimeter; wherein the inner leg section is positioned within the outer perimeter of the outer leg section and pivotally coupled thereto.

3. The bed frame of claim 2, further comprising a second actuating assembly comprising: a second actuator coupled to a second movable jack extending therefrom, the second actuator pivotally coupled to the at least one structural support bar of the outer leg section; and a second bracket comprising a first end and a second end, said first end pivotally coupled to the at least one structural support bar of the inner leg section and said second end pivotally coupled to a distal end of the second movable jack, wherein the second movable jack is fully extended when the inner leg section and the outer leg section are substantially co-planar and the second movable jack is less than fully extended when the inner leg section is raised from the outer leg section.

4. The bed frame of claim 3, wherein the inner leg section further comprises at least two portions pivotally coupled together.

5. The bed frame of claim 4, wherein at least one of the portions of the inner leg section is substantially horizontal when the inner leg section is raised from the outer leg section.

6. The bed frame of claim 1, wherein the torso sections and outer assembly leg section are foldable from an open configuration wherein the torso sections and outer assembly leg section are substantially co-planar, to a folded configuration wherein the torso sections and outer assembly leg section are substantially parallel.

7. A bed frame comprising:

an outer assembly comprising: an outer torso section and an outer leg section, said outer torso and outer leg sections each having a frame defining an outer perimeter; at least one structural support bar coupled to each of said outer torso and outer leg sections and positioned within the outer perimeter; and at least one support leg pivotally coupled to each of said outer torso and outer leg sections;

a central leg assembly having at least one support leg, the outer torso and outer leg sections pivotally coupled together by the central leg assembly;

an inner assembly comprising: an inner torso section, the inner torso section having a frame defining an inner perimeter; and at least one structural support bar coupled to said inner torso section and positioned within the inner perimeter; wherein the inner torso section is positioned within the outer perimeter of the outer torso section and pivotally coupled thereto; and a first actuating assembly comprising: a first actuator coupled to a first movable jack extending therefrom; and a first bracket comprising a first end and a second end;

wherein one of the first actuator and first movable jack is pivotally coupled to the at least one structural support bar of the outer torso section, the other one of the first actuator and first movable jack is pivotally coupled to the first bracket first end, and the first bracket second end is pivotally coupled to the at least one structural support bar of the inner torso section.

8. The bed frame of claim 7, wherein the inner assembly further comprises an inner leg section, the inner leg section having a frame defining an inner perimeter; and at least one structural support bar coupled to said inner leg section and positioned within the inner perimeter; wherein the inner leg section is positioned within the outer perimeter of the outer leg section and pivotally coupled thereto.

9. The bed frame of claim 8, further comprising a second actuating assembly comprising: a second actuator coupled to a second movable jack extending therefrom; and a second bracket comprising a first end and a second end;

wherein one of the second actuator and second movable jack is pivotally coupled to the at least one structural support bar of the outer leg section, the other one of the second actuator and second movable jack is pivotally coupled to the second bracket first end, and the second bracket second end is pivotally coupled to the at least one structural support bar of the inner leg section.

10. The bed frame of claim 9, wherein the bracket second end of at least one of the first and second actuating assemblies further comprises a slot, the corresponding movable jack being slidable therein.

11. The bed frame of claim 7, wherein the first bracket further comprises an intermediate portion between the first and second ends, said intermediate portion pivotally coupled to at least one of the inner torso section and the outer torso section.

12. The bed frame of claim 7, wherein the first actuator and first movable jack are positioned below the outer assembly when the inner assembly is in a flat configuration and when the inner assembly is in a raised configuration.

13. The bed frame of claim 7, wherein the outer torso section includes a seat portion extending within the outer perimeter and adjacent to the inner torso section.

* * * * *